US006632150B1

(12) United States Patent
Ogg

(10) Patent No.: US 6,632,150 B1
(45) Date of Patent: Oct. 14, 2003

(54) GOLF BALL HAVING A SINUSOIDAL SURFACE

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/323,466

(22) Filed: Dec. 18, 2002

Related U.S. Application Data

(60) Provisional application No. 60/342,801, filed on Dec. 21, 2001.

(51) Int. Cl.[7] ..... A63B 37/12
(52) U.S. Cl. ..... 473/378
(58) Field of Search ..... 473/378, 383, 473/384

(56) References Cited

U.S. PATENT DOCUMENTS

| | | | | | |
|---|---|---|---|---|---|
| D29,949 | S | | 1/1899 | Barnes | |
| 1,286,834 | A | * | 12/1918 | Taylor | 473/384 |
| 1,517,514 | A | | 12/1924 | Hunt | |
| 2,002,726 | A | | 5/1935 | Young | |
| 3,227,456 | A | | 1/1966 | Sonneman | |
| D243,866 | S | | 3/1977 | Shaw et al. | |
| D247,685 | S | | 4/1978 | Haines et al. | |
| 4,090,716 | A | | 5/1978 | Martin et al. | |
| 4,142,727 | A | | 3/1979 | Shaw et al. | |
| 4,266,773 | A | | 5/1981 | Treadwell | |
| 4,560,168 | A | | 12/1985 | Aoyama | |
| 4,653,758 | A | * | 3/1987 | Solheim | 473/377 |
| 4,722,529 | A | | 2/1988 | Shaw et al. | |
| D294,615 | S | | 3/1988 | Shaw et al. | |
| 4,762,326 | A | | 8/1988 | Gobush | |
| 4,765,626 | A | | 8/1988 | Gobush | |
| 4,772,026 | A | | 9/1988 | Gobush | |
| 4,787,638 | A | | 11/1988 | Kobayashi | |
| 4,804,189 | A | | 2/1989 | Gobush | |
| 4,830,378 | A | | 5/1989 | Aoyama | |
| 4,836,552 | A | | 6/1989 | Puckett et al. | |
| 4,840,381 | A | | 6/1989 | Ihara et al. | |
| 4,844,472 | A | | 7/1989 | Ihara | |
| 4,858,923 | A | | 8/1989 | Gobush et al. | |
| 4,867,459 | A | | 9/1989 | Ihara | |
| 4,869,512 | A | | 9/1989 | Nomura et al. | |
| 4,877,252 | A | | 10/1989 | Shaw | |
| 4,915,389 | A | | 4/1990 | Ihara | |
| 4,936,587 | A | | 6/1990 | Lynch et al. | |
| 4,948,143 | A | | 8/1990 | Aoyama | |
| 4,979,747 | A | | 12/1990 | Jonkouski | |
| 5,016,887 | A | | 5/1991 | Jonkouski | |
| 5,024,444 | A | | 6/1991 | Yamagishi et al. | |
| 5,033,750 | A | | 7/1991 | Yamagishi et al. | |
| D319,481 | S | | 8/1991 | Shaw | |
| D319,482 | S | | 8/1991 | Shaw | |
| D319,483 | S | | 8/1991 | Machin et al. | |
| 5,044,638 | A | * | 9/1991 | Nesbitt et al. | 473/383 |
| 5,062,644 | A | | 11/1991 | Lee | |
| 5,064,199 | A | | 11/1991 | Morell | |
| 5,087,049 | A | | 2/1992 | Yamagishi et al. | |
| 5,123,652 | A | | 6/1992 | Oka | |
| 5,143,377 | A | | 9/1992 | Oka et al. | |
| 5,145,180 | A | | 9/1992 | Oka | |
| 5,158,300 | A | | 10/1992 | Aoyama | |
| 5,174,578 | A | | 12/1992 | Oka et al. | |
| 5,249,804 | A | * | 10/1993 | Sanchez | 473/379 |
| 5,292,132 | A | | 3/1994 | Oka | |

(List continued on next page.)

*Primary Examiner*—Steven Wong
*Assistant Examiner*—Raeann Gorden
(74) *Attorney, Agent, or Firm*—Michael A. Catania

(57) ABSTRACT

A golf ball having a sinusoidal surface is disclosed. The golf ball has a sinusoidal structure. The golf ball of the present invention conforms with the 1.68 inches diameter requirement for USGA approved golf balls. The interconnected sine waves form a sinusoidal structure in the preferred embodiment. The preferred embodiment has a parting line that alternates upward and downward along a sine wave.

8 Claims, 10 Drawing Sheets

U.S. PATENT DOCUMENTS

| | | | | | |
|---|---|---|---|---|---|
| 5,308,076 | A | | 5/1994 | Sun | |
| 5,338,039 | A | | 8/1994 | Oka et al. | |
| 5,377,989 | A | | 1/1995 | Machin | |
| 5,441,276 | A | | 8/1995 | Lim | |
| 5,470,076 | A | | 11/1995 | Cadorniga | |
| 5,536,013 | A | | 7/1996 | Pocklington | |
| 5,575,477 | A | | 11/1996 | Hwang | |
| 5,601,503 | A | | 2/1997 | Yamagishi | |
| 5,720,676 | A | | 2/1998 | Shimosaka et al. | |
| D393,671 | S | | 4/1998 | Honaker | |
| 5,857,924 | A | | 1/1999 | Miyagawa et al. | |
| 5,863,264 | A | | 1/1999 | Yamagishi et al. | |
| 5,906,551 | A | | 5/1999 | Kasashima et al. | |
| 5,908,359 | A | | 6/1999 | Shimosaka et al. | |
| 5,911,639 | A | * | 6/1999 | Kasashima et al. | 473/377 |
| 5,916,044 | A | | 6/1999 | Shimosaka et al. | |
| 5,935,023 | A | | 8/1999 | Machara et al. | |
| 6,290,615 | B1 | | 9/2001 | Ogg | |
| 6,315,685 | B1 | | 11/2001 | Tavares et al. | |
| 6,383,092 | B1 | | 5/2002 | Ogg | |
| 6,390,740 | B1 | | 5/2002 | Nesbitt et al. | |
| 6,478,698 | B2 | * | 11/2002 | Melvin et al. | 473/383 |
| 2002/0187855 | A1 | * | 12/2002 | Park et al. | 473/351 |
| 2003/0083153 | A1 | * | 5/2003 | Sullivan et al. | 473/351 |

* cited by examiner

GOLF BALL HAVING A SINUSOIDAL SURFACE

CROSS-REFERENCES TO RELATED APPLICATIONS

This application is a continuation of U.S. Patent Application No. 60/342,801, filed on Dec. 21, 2001.

STATEMENT REGARDING FEDERALLY SPONSORED RESEARCH OR DEVELOPMENT

Not Applicable

BACKGROUND OF THE INVENTION

1. Field of the Invention

The present invention relates to an aerodynamic surface pattern for a golf ball. More specifically, the present invention relates to a golf ball having a sinusoidal surface.

2. Description of the Related Art

Golfers realized perhaps as early as the 1800s that golf balls with indented surfaces flew better than those with smooth surfaces. Hand-hammered gutta-percha golf balls could be purchased at least by the 1860s, and golf balls with brambles (bumps rather than dents) were in style from the late 1800s to 1908. In 1908, an Englishman, William Taylor, received a British patent for a golf ball with indentations (dimples) that flew better and more accurately than golf balls with brambles. A. G. Spalding & Bros. Purchased the U.S. rights to the patent (embodied possibly in U.S. Pat. No. 1,286,834, issued in 1918) and introduced the GLORY ball featuring the TAYLOR dimples. Until the 1970s, the GLORY ball and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty-year period came from Albert Penfold, who invented a mesh-pattern golf ball for Dunlop. This pattern was invented in 1912 and was accepted until the 1930s. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, each dimple having a circular cross-section. Many golf balls have been disclosed that break with this tradition, however, for the most part these non-traditional golf balls have been commercially unsuccessful.

Most of these non-traditional golf balls still attempt to adhere to the Rules of Golf, as set forth by the United States Golf Association ("USGA") and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm), which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044 for a Golf Ball, which discloses the use of protrusions to meet the 1.68 inch (42.67 mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378 for a Golf Ball with Uniform Land Configuration, discloses a golf ball with dimples that have triangular shapes. The total flat land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball and Method of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. D406,623, has all elongated dimples.

A variation on this theme is set forth in Moriyama et al., U.S. Pat. No. 5,722,903 for a Golf Ball, which discloses a golf ball with traditional dimples and oval-shaped dimples.

A further example of a non-traditional golf ball is set forth in Shaw et al., U.S. Pat. No. 4,722,529 for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076 for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377 for a Golf Ball, discloses circular and non-circular dimples. The non-circular dimples are square, regular octagonal, regular hexagonal, and amount to at least forty percent of the 332 dimples on the golf ball of Oka. These non-circular dimples of Oka have a double slope that sweeps air away from the periphery in order to make the air turbulent.

Machin, U.S. Pat. No. 5,377,989 for Golf Balls with Isodiametrical Dimples, discloses a golf ball having dimples with an odd number of curved sides and arcuate apices to reduce the drag on the golf ball during flight.

Lavallee et al., U.S. Pat. No. 5,356,150 for a Golf Ball, discloses a golf ball having overlapping elongated dimples to obtain maximum dimple coverage on the surface of the golf ball.

Oka et al., U.S. Pat. No. 5,338,039 for a Golf Ball, discloses a golf ball having at least 40% of its dimples with a polygonal shape. The shapes of the Oka golf ball are pentagonal, hexagonal and octagonal.

Although the prior art has set forth numerous variations for the surface of a golf ball, there remains a need for a golf ball having a surface that minimizes the volume needed to trip the boundary layer of air at low speeds.

BRIEF SUMMARY OF THE INVENTION

The present invention is able to provide a golf ball that meets the USGA requirements and provides a minimum area to trip the boundary layer of air surrounding a golf ball during flight, thereby creating the necessary turbulence to achieve greater distance. The present invention is able to accomplish this by providing a golf ball with a sinusoidal surface. The surface perturbations do not affect putting performance. The total frontal area is minimized but is still sufficient to trip the boundary layer.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
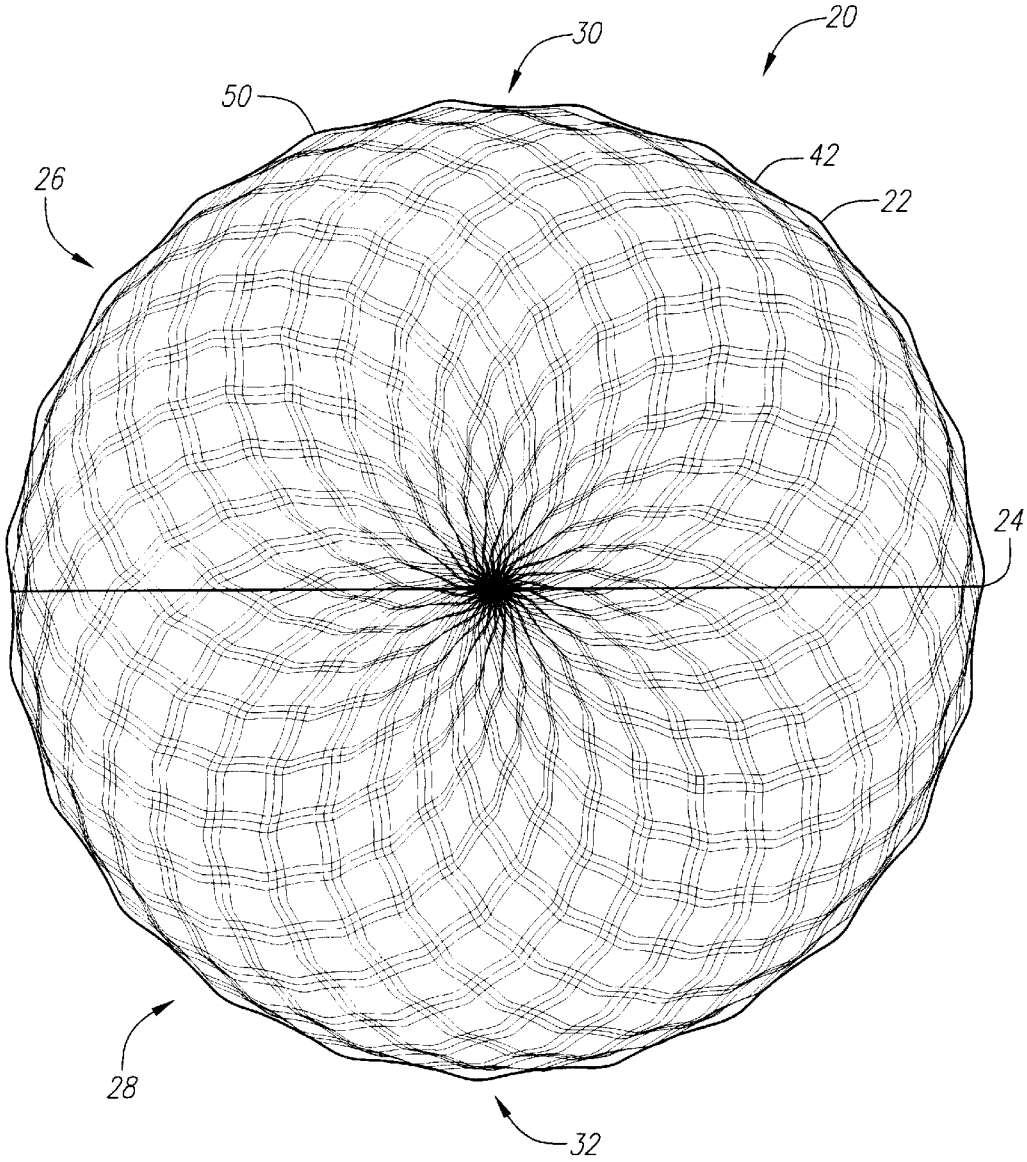
FIG. 1 is an equatorial view of a golf ball of the present invention.
Figure 2:
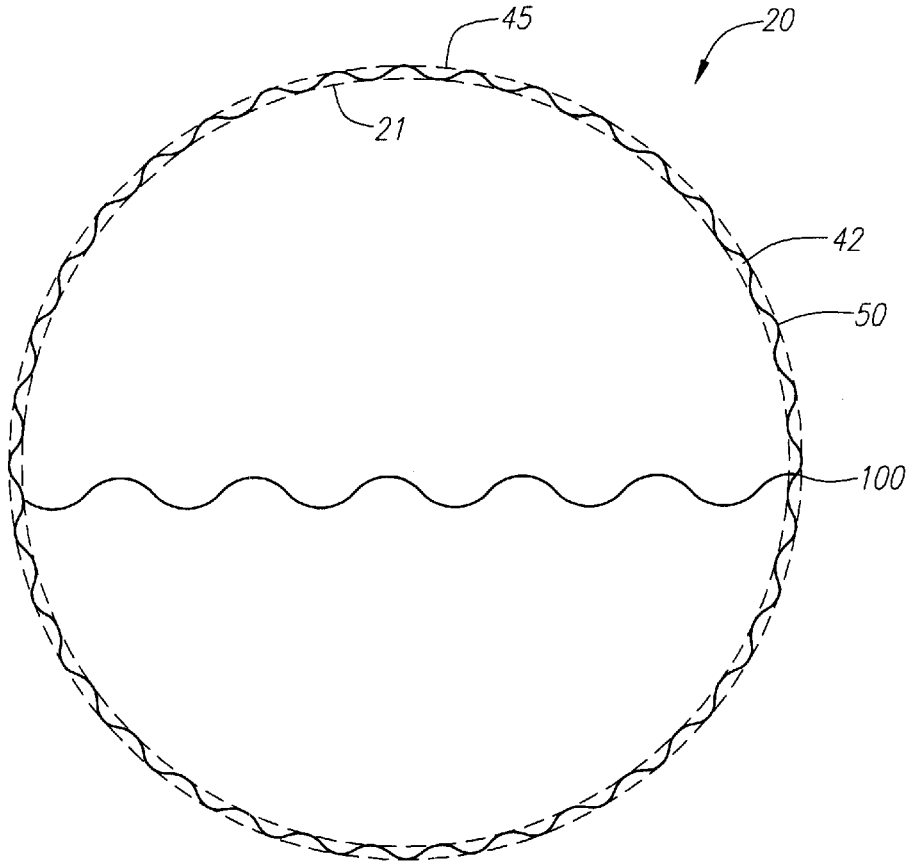
FIG. 2 is an equatorial outline view of the golf ball of FIG. 1.

As shown in FIGS. 1 and 2, a golf ball 20 may be a two-piece golf ball, a three-piece golf ball, or a multiple layer golf ball. Further, the three-piece golf ball may have a wound layer or a solid boundary layer. Additionally, the core of the golf ball 20 may be solid, hollow or filled with a fluid, such as a gas or liquid. The core of the golf ball 20 may be any suitable material. A preferred solid three-piece golf ball with a cover composed of a thermoset polyurethane material is disclosed in U.S. Pat. No. 6,190,268, for a Golf Ball with a Polyurethane Cover, which is hereby incorporated by reference. A preferred two-piece golf ball with a cover composed of an ionomer material is disclosed in co-pending U.S. patent application Ser. No. 09/847,094, for a Golf Ball, which is hereby incorporated by reference. A preferred high COR golf ball is disclosed in U.S. Pat. No. 6,443,858, for a Golf Ball with a High Coefficient of Restitution, which is hereby incorporated by reference. Those skilled in the pertinent art will recognize that other materials for making the golf ball 20 may be utilized without departing from the scope and spirit of the present invention. The golf ball 20 may have a finish of a basecoat and/or top coat.

The golf ball 20 has a sinusoidal surface 22. The golf ball 20 also has an equator 24 that divides the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

The sinusoidal surface 22 has a sinusoidal structure 42 that is formed by a plurality of sine waves. Each sine wave of the sinusoidal surface preferably has an amplitude that ranges from 0.005 inch to 0.100 inch, more preferably 0.009 inch to 0.05 inch, and much more preferably 0.01 inch to 0.03 inch, thereby preferably defining an outersphere of at least 1.68 inches.

The preferred embodiment of the present invention has reduced the land area to almost zero, since only a point of each of the sine waves is in a spherical plane at 1.68 inches in diameter or greater, the outersphere. Those skilled in the art will recognize that the outersphere diameter could be less than 1.68 inches, however, the current Rules of Golf dictate that the diameter be at least 1.68 inches. More specifically, the land area of traditional golf balls is the area forming a sphere having a diameter of at least 1.68 inches for USGA and R&A conforming golf balls. This land area is traditionally minimized with dimples that are concave into the surface of the sphere of the traditional golf ball, resulting in land area on the non-dimpled surface of the golf ball. However, the golf ball 20 of the present invention has only a point at an apex 50 of each of the sine waves that defines the land area of the outersphere of the golf ball 20.

Traditional golf balls were designed with dimples to "trip" the boundary layer of air on the surface of the golf ball in flight to create a turbulent flow for greater lift and reduced drag. The sinusoidal structure 42 of the golf ball 20 of the present invention trips the boundary layer of air about the surface of the golf ball 20 in flight.

As shown in the FIG. 2, a 1.68 inches outersphere, as shown by dashed line 45, encompasses the sinusoidal structure 42. The volume of the sinusoidal structure 42 as measured from the bottom of each sine wave to the apex 50 is a minimal amount of the volume between the 1.68 inches outersphere and an innersphere 21. In the preferred embodiment, the apex 50 lies on the 1.68 inches outersphere. Thus, over 90 percent, and closer to 95 percent, of the entire volume of the golf ball 20 lies below the 1.68 inches outersphere.

Figure 3:
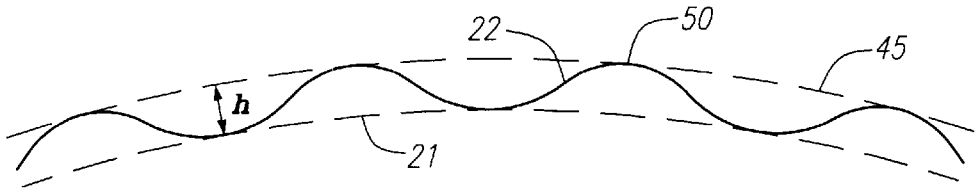
FIG. 3 is an enlarged cross-sectional view demonstrating the amplitude of a sine wave.
Figure 4:
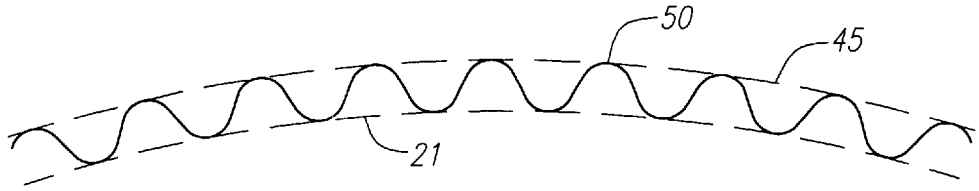
FIG. 4 is an enlarged cross-sectional view demonstrating the amplitude of a higher frequency sine wave than that of FIG. 3.

As shown in the FIGS. 3 and 4, the distance h and h' of the sine waves from the bottom of each sine wave to an apex 50 will vary in order to have the golf ball 20 meet or exceed the 1.68 inches requirement. For example, if the diameter of the innersphere 21 is 1.666 inches, then the distance h of the sine wave is 0.007 inch, since the sine wave on one hemisphere 26 is combined with a corresponding sine wave on the second hemisphere 28 to reach the 1.68 inches requirement. In a preferred embodiment, if sine waves having a greater distance h' are desired, then the innersphere 21 has a lesser diameter. Thus, for example, the diameter of the innersphere 21 is 1.662 inches while the distance h' of each of the sine waves is 0.009 inch, thereby resulting in an outersphere with a diameter of 1.68 inches. As shown in the FIGS. 3 and 4, the width of each of the apices 50 is minimal, since each apex 50 is a point of the sine wave. In theory, the width of each apex 50 should approach the width of a point. In practice, however, the width of each apex 50 of each sine wave is determined by the precision of the mold utilized to produce the golf ball 20. The precision of the mold is itself determined by the master that is used to form the mold. In practice, the width of each apex 50 ranges from 0.0001 inch to 0.001 inch.

Referring back to FIG. 2, a preferred embodiment of the golf ball 20 of the present invention has a parting line 100 that corresponds to the shape of a sine wave about the equator 24. Thus, the amplitude of the sine wave will determine the number of crossings of the parting line 100. Such a golf ball 20 is fabricated using a mold such as that disclosed in co-pending U.S. patent application Ser. No. 09/442,845, filed on Nov. 18, 1999, entitled Mold for a Golf Ball, which is incorporated herein by reference.

The golf ball 20 of the present invention was constructed as set forth in U.S. Pat. No. 6,117,024, filed on Jul. 27, 1999, for a Golf Ball with a Polyurethane Cover, which pertinent parts are hereby incorporated by reference. However, those skilled in the pertinent art will recognize that other materials may be used in the construction of the golf ball of the present invention. The aerodynamics of the sinusoidal structure 42 of the present invention provides a golf ball that travels a greater distance than traditional golf balls of similar constructions.

In this regard, the Rules of Golf, approved by the USGA and the R&A, limit the initial velocity of a golf ball to 250 feet (76.2 m) per second (a two percent maximum tolerance allows for an initial velocity of 255 feet per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org or the R&A web page at www.randa.org. Thus, the initial velocity and overall distance of a golf ball must not exceed these limits in order to conform to the Rules of Golf. Therefore, the golf ball 20 should have an aerodynamic pattern that enables the golf ball 20 to meet, yet not exceed, these limits.

Figure 5:
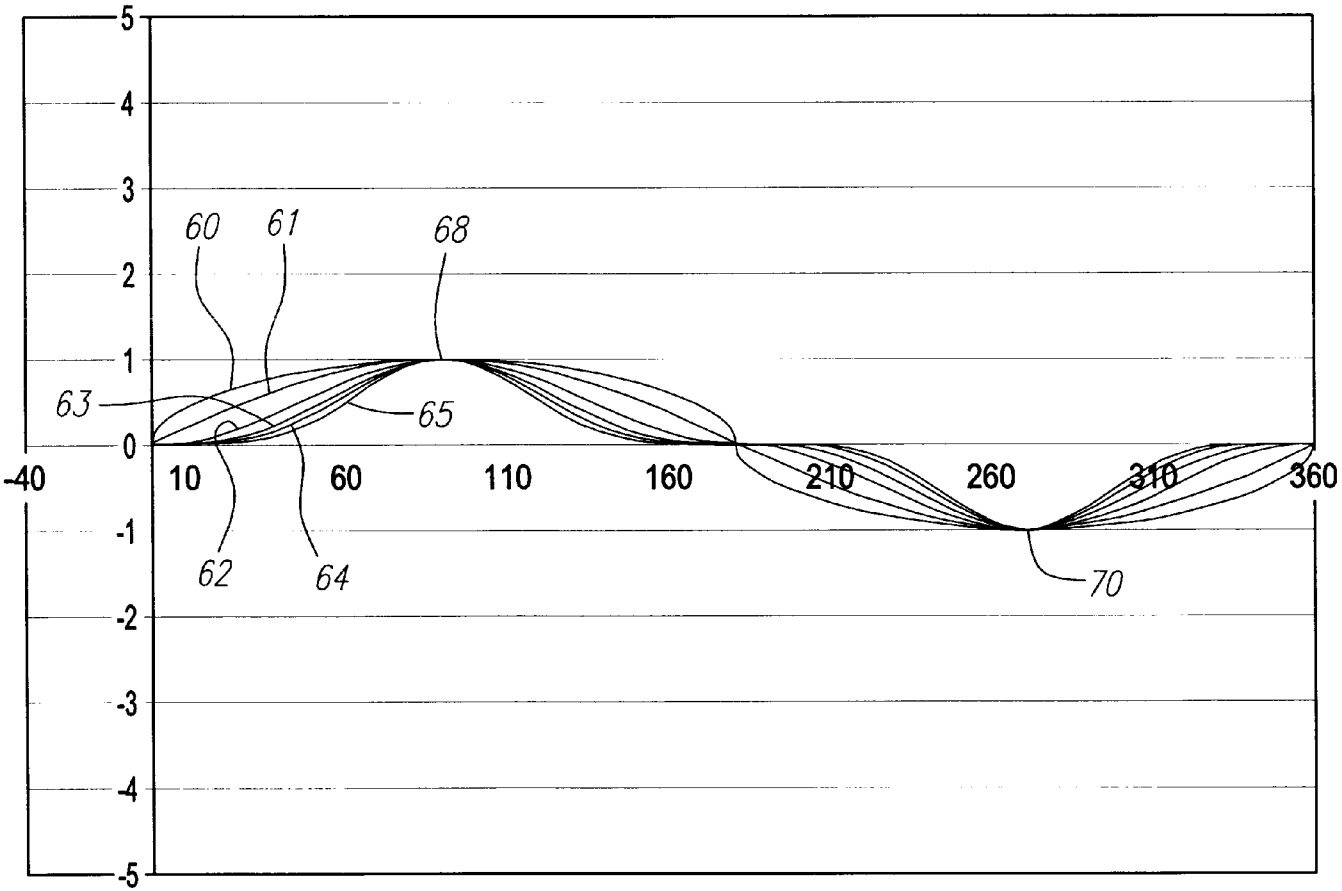
FIG. 5 is a graph showing different powers of a sine wave with various modulations.

The sine waves that define the surface of the golf ball 20 have varying amplitudes and frequencies. FIG. 5 illustrates six different powers 60–65 of a sine wave with various modulations. Each power of the sine wave 60–65 has a period that begins at zero, has a maximum 68 at a first quarter of the period (90 degrees), is zero halfway through the period (180 degrees), has a minimum 70 at three-quarters of the period (270 degrees), and is zero again at the end of the period (360 degrees). The period or wavelength of the sine wave defines the sinusoidal surface 22. Each maximum 68 of the sine wave of each wavelength is an apex 50 at the outersphere 45, and the minimum 70 is the lowest point of the surface 22 at the innersphere 21. Each apex 50 is the maximum of more than one sine wave. In one embodiment, all of the sine waves have the same frequency.

Figure 6:
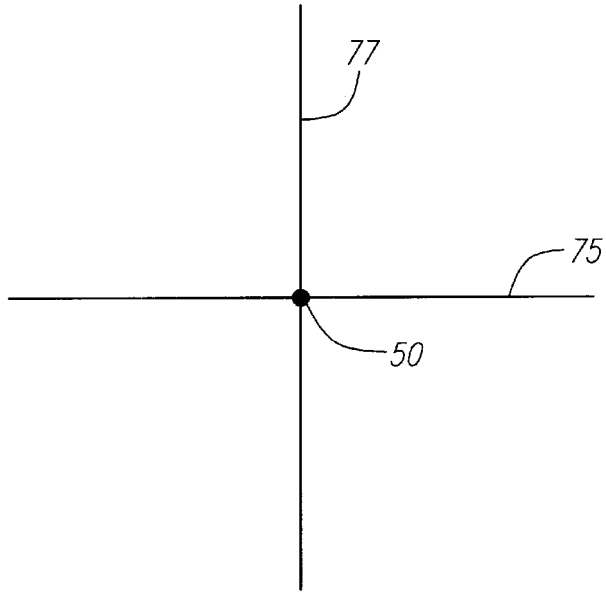
FIG. 6 is an isolated top view of two sine waves intersecting at an apex.
Figure 7:
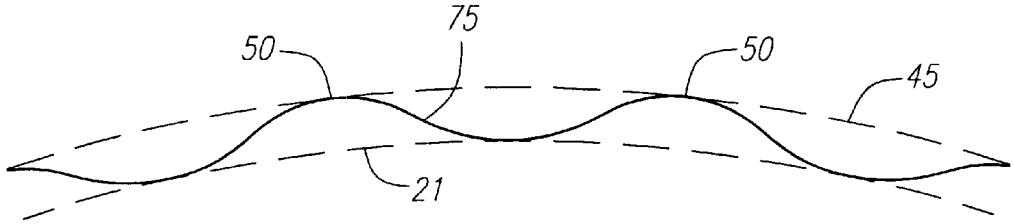
FIG. 7 is a cross-sectional view of sine wave 75 of FIG. 6.
Figure 8:
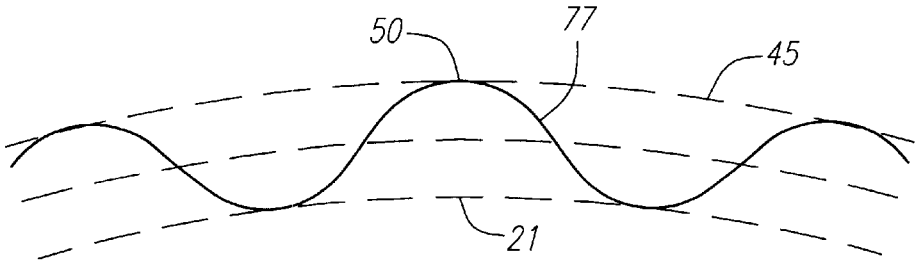
FIG. 8 is a cross-sectional view of sine wave 77 of FIG. 6.

As shown in FIG. 6, in an alternative embodiment, an apex 50 has a first sine wave 75 with a maximum at the apex 50, and a second sine wave 77 with a maximum at the apex 50. As shown in FIG. 7, sine wave 75 has a first frequency, while sine wave 77 has a second frequency, as shown in FIG. 8. The frequency can be defined as the number of wavelengths per quarter (90 degrees) of the circumference of the golf ball 20. As shown in FIGS. 7 and 8, sine wave 75 has twice the frequency as sine wave 77.

Figure 9:
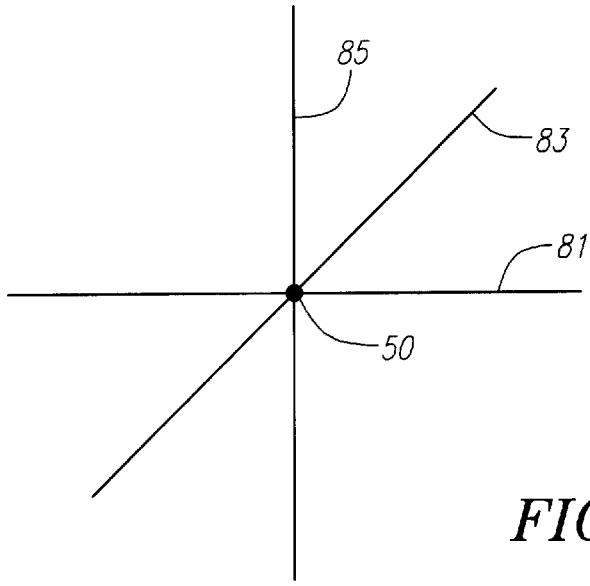
FIG. 9 is an isolated top view of three sine waves intersecting at an apex.
Figure 10:
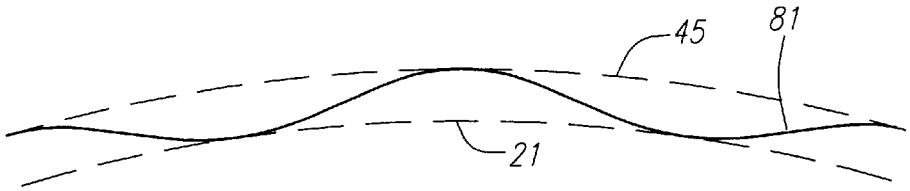
FIG. 10 is a cross-sectional view of sine wave 81 of FIG. 9.
Figure 11:
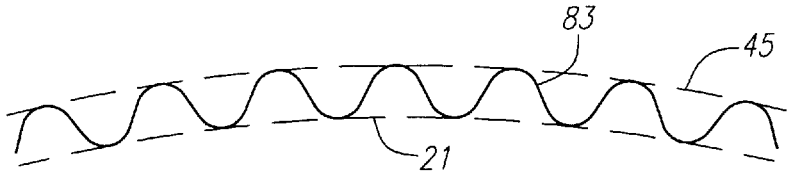
FIG. 11 is a cross-sectional view of sine wave 83 of FIG. 9.
Figure 12:
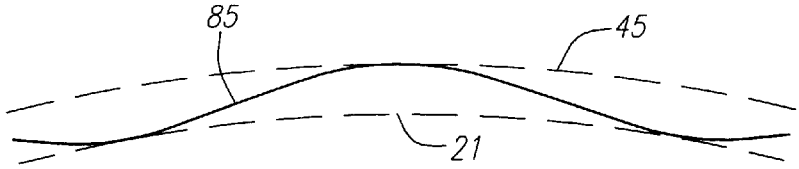
FIG. 12 is a cross-sectional view of sine wave 87 of FIG. 9.

As shown in FIG. 9, another embodiment has an apex 50 with three sine waves 81, 83 and 85 shown. As shown in FIGS. 10–12 the frequency of sine wave 81 is much less than the frequency of sine wave 83, and both sine waves 81 and 83 are greater than sine wave 85.

Figure 13:
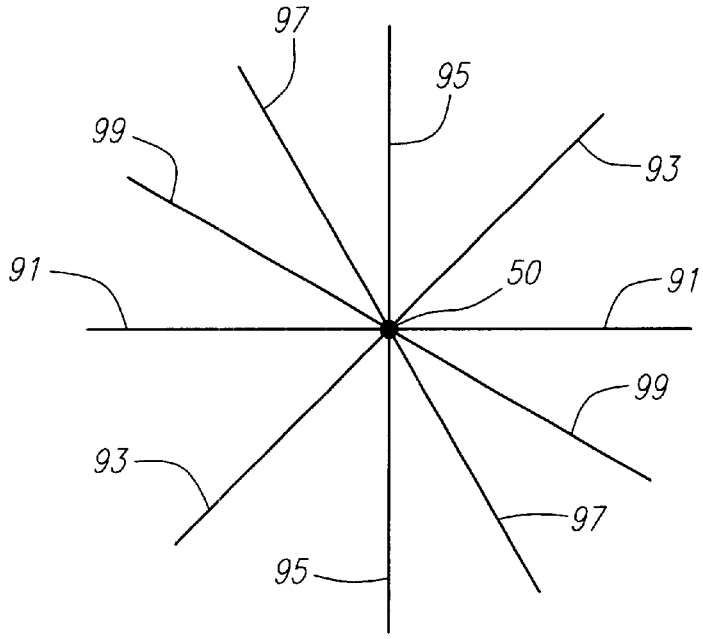
FIG. 13 is an isolated to view of five sine waves intersecting at an apex.
Figure 14:
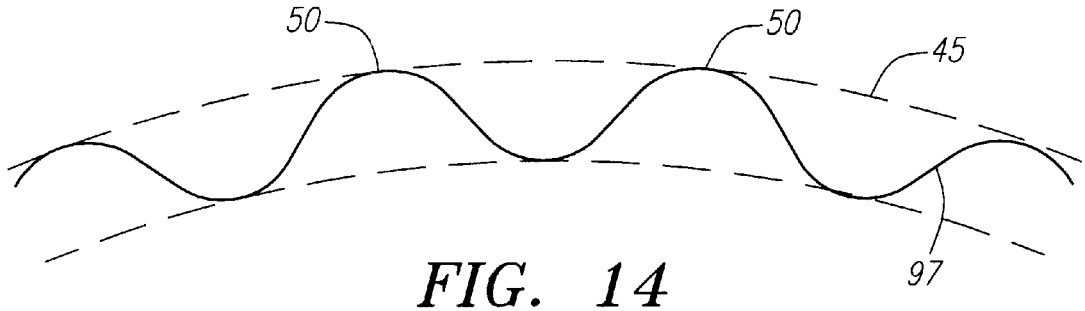
FIG. 14 is a cross-sectional view of sine wave 97 of FIG. 13.
Figure 15:
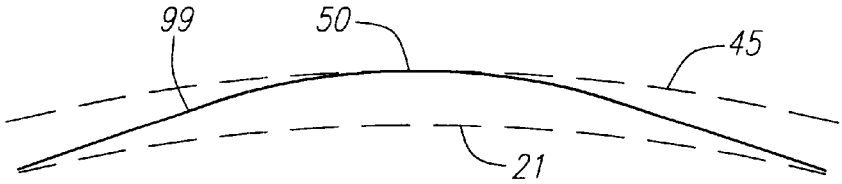
FIG. 15 is a cross-sectional view of sine wave 99 of FIG. 13.
Figure 16:
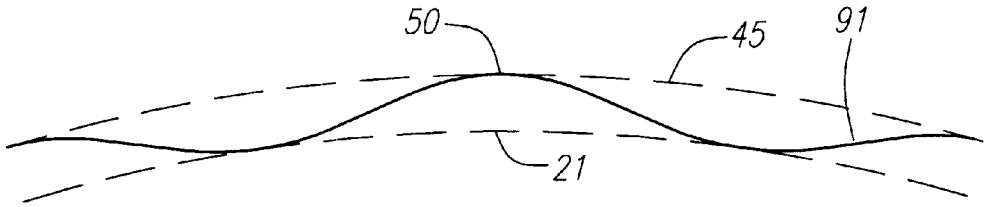
FIG. 16 is a cross-sectional view of sine wave 91 of FIG. 13.
Figure 17:
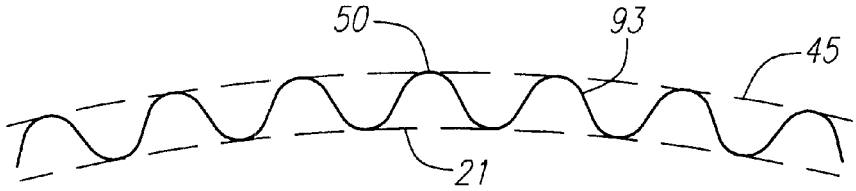
FIG. 17 is a cross-sectional view of sine wave 93 of FIG. 13.
Figure 18:
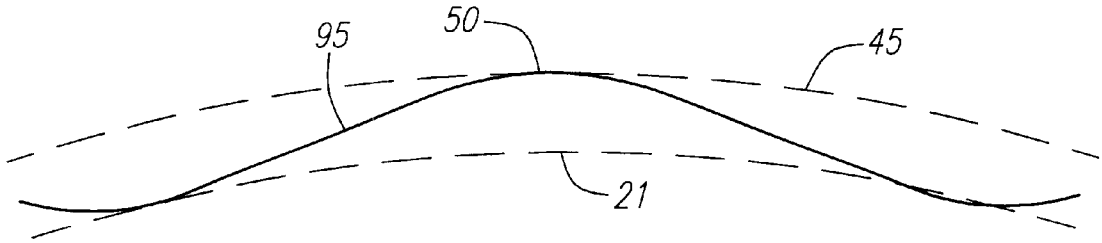
FIG. 18 is a cross-sectional view of sine wave 95 of FIG. 13.

As shown in FIG. 13, yet another embodiment has an apex 50 with five sine waves, 91, 93, 95, 97 and 99, with different frequencies. As shown in FIGS. 14–18, sine wave 93 has the greatest frequency, while sine wave 99 has the lowest frequency.

Figure 19:
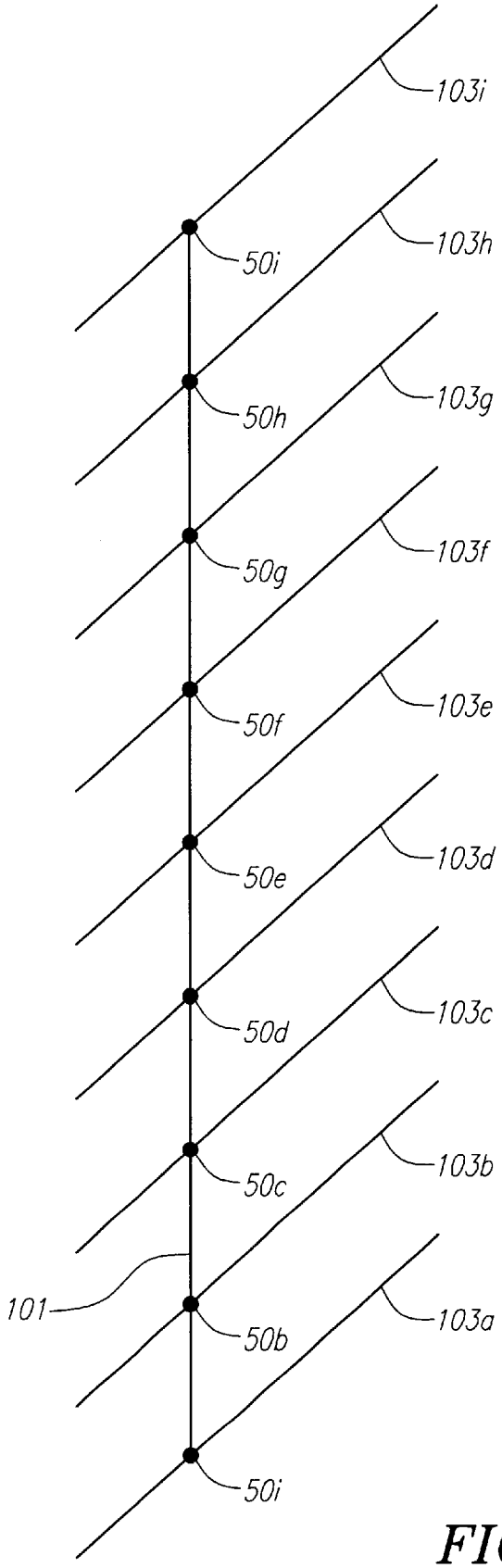
FIG. 19 is an isolated view of a sine wave along one quarter length of the golf ball with intersecting parallel sine waves.

FIG. 19 illustrates a sine wave 101 with eight apices 50*a*–50*i* where there is a maximum of the sine wave 101. The sine wave as shown extends along a quarter length of the circumference of the golf ball 20. Each period or wavelength of the sine wave 101 beings at a location one quarter of the length before an apex 50 and ends three-quarters length from the apex along the sine wave 101. Parallel sine waves 103*a*–103*i* have maximums at the apices 50*a*–50*i*, respectively, at approximately 45 degrees with respect to the sine wave 101.

Figure 20:
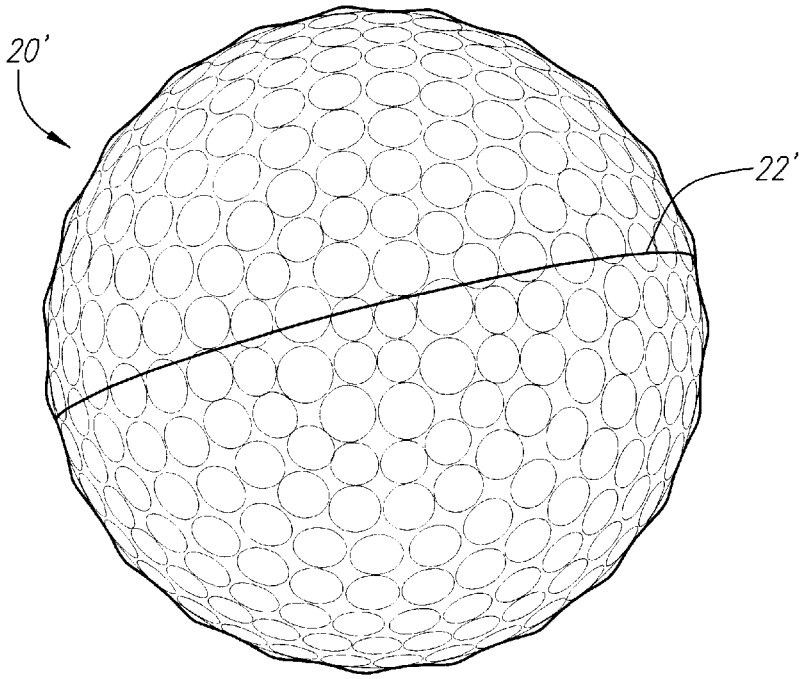
FIG. 20 is an equatorial view of another embodiment of a golf ball with a sinusoidal surface.
Figure 21:
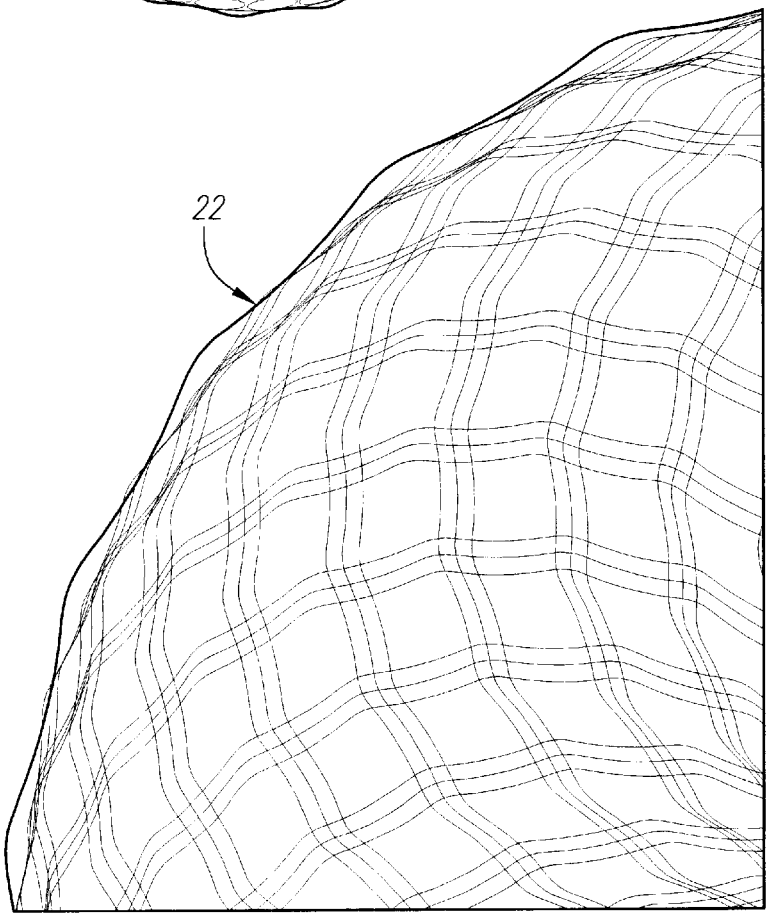
FIG. 21 is a partial enlarged view of a golf ball of the present invention.

FIG. 20 illustrates another embodiment of a golf ball 20' with a sinusoidal surface 22'. FIG. 21 is an enlarged partial view of the golf ball 20 of the present invention showing the sinusoidal surface 22 in greater detail.

Figure 22:
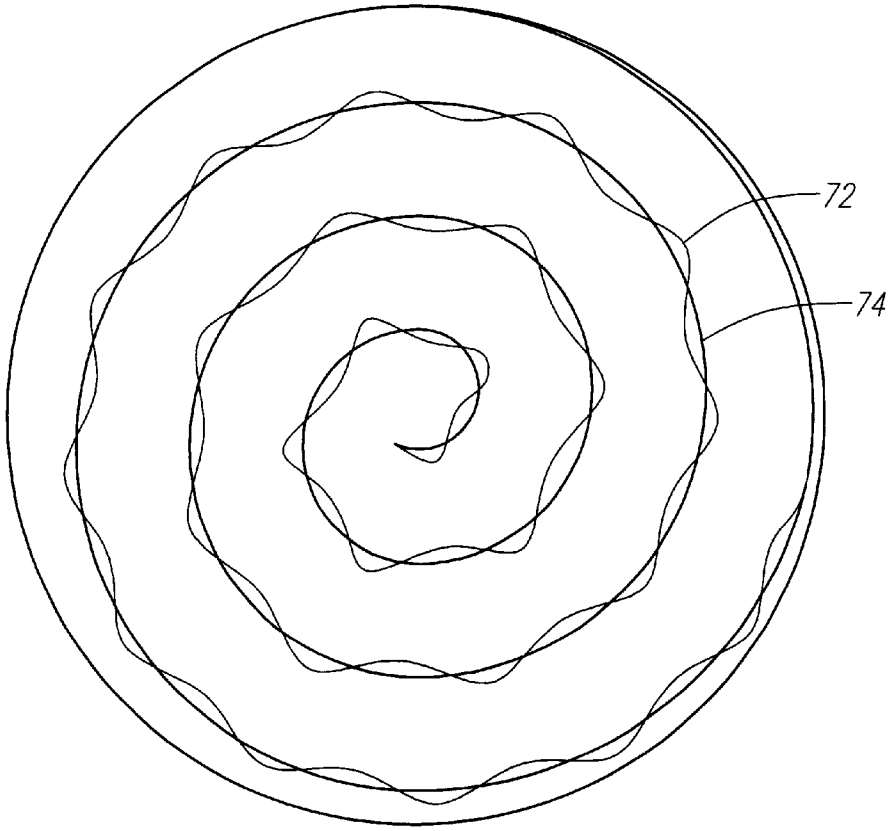
FIG. 22 illustrates a sine wave in an isolated helical sine wave.

FIG. 22 illustrates a sine wave 72 in an isolated helical sine wave 74. The sine wave 72 extends radially in and out of the golf ball.

Figure 23:
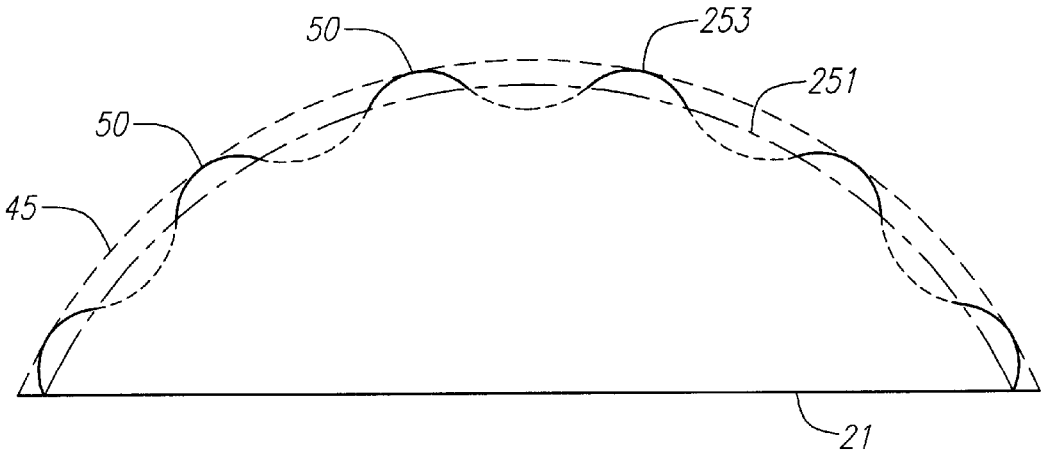
FIG. 23 illustrates another embodiment where two sine waves overlap to define the sinusoidal surface.

FIG. 23 illustrates an embodiment of the sinusoidal surface 22 where multiple sine waves overlap to define the surface of the golf ball 20. In FIG. 23, sine wave 253 overlaps sine wave 251. The frequency of sine wave 251 is much lower than sine wave 253. Also, the apices 50 that define the outersphere 45 use the maximums of the sine wave 253, while the minimums are limited by sine wave 251.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball comprising a sinusoidal surface, the sinusoidal surface covering the entire golf ball, wherein the golf ball includes a first hemisphere and a second hemisphere, the first and second hemispheres being connected together along a parting line, the parting line having a sine wave configuration.

2. The golf ball according to claim 1, wherein the sinusoidal surface includes a plurality of sine waves overlapping to define the sinusoidal surface.

3. The golf ball according to claim 2, wherein at least one of the sine waves has a frequency different from that of another sine wave.

4. The golf ball according to claim 1, wherein the sinusoidal surface is a helical sinusoidal surface.

5. A golf ball comprising:

a first hemisphere having a sinusoidal surface; and a second hemisphere having a sinusoidal surface, the second hemisphere being coupled to the first hemisphere along a parting line, the parting line having a sine wave configuration, wherein the golf ball has an outersphere diameter of at least 1.68 inches.

6. The golf ball according to claim 5, wherein each of the sinusoidal surfaces includes a plurality of sine waves overlapping to define the sinusoidal surface.

7. The golf ball according to claim 6, wherein at least one of the sine waves has a frequency different from that of another sine wave.

8. The golf ball according to claim 5, wherein each of the sinusoidal surfaces is a helical sinusoidal surface.

* * * * *